United States Patent [19]

Thumm et al.

[11] 4,401,277

[45] Aug. 30, 1983

[54] APPARATUS FOR PRODUCING MECHANICAL WOOD PULP

[75] Inventors: Helmut Thumm; Theodor Bähr; Hans Henrich, all of Heidenheim, Fed. Rep. of Germany

[73] Assignee: J. M. Voith GmbH, Fed. Rep. of Germany

[21] Appl. No.: 254,064

[22] Filed: Apr. 14, 1981

[30] Foreign Application Priority Data

Apr. 17, 1980 [DE] Fed. Rep. of Germany ..... 3014802

[51] Int. Cl.[3] ..... B02C 19/12; B02C 23/18

[52] U.S. Cl. ..... 241/38; 241/28; 241/66; 241/282

[58] Field of Search ..... 241/21, 28, 62, 66, 241/166, 167, 280, 281, 282, 293, 38, 44, 15

[56] References Cited

U.S. PATENT DOCUMENTS

| | | | |
|---|---|---|---|
| 4,881 | 4/1872 | Voelter | 241/28 X |
| 1,132,258 | 3/1915 | Hall | 241/28 |
| 2,512,523 | 6/1950 | Fisher et al. | 241/167 |
| 3,693,891 | 9/1972 | Remmer | 241/28 X |

FOREIGN PATENT DOCUMENTS

| | | | |
|---|---|---|---|
| 648569 | 9/1962 | Canada | 241/28 |
| 2812299 | 9/1979 | Fed. Rep. of Germany . | |

*Primary Examiner*—Mark Rosenbaum

*Attorney, Agent, or Firm*—Ostrolenk, Faber, Gerb & Soffen

[57] ABSTRACT

The disclosure relates to apparatus for producing mechanical wood pulp of the type having a grinding stone with at least one wood supply chute in which the wood which is to be ground is pressed onto the grinding stone. A trough or a collecting channel is placed underneath the grinding stone. A water supply device moistens the grinding stone at the grinding zone. At least one closed water tank is set up on the grinding stone in front of the wood supply chute, viewed in the direction of rotation of the grinding stone. The water tank is sealed at least on the side furthest away from the supply chute. The tank has a supply line for pressurized water and has outlet holes directed toward the surface of the stone. Preferably, sealing of the water tank is effected by a sealing plug at the grinding stone which plug is adjustable with respect to the grinding stone to accommodate wear of the plug from the stone.

23 Claims, 2 Drawing Figures

APPARATUS FOR PRODUCING MECHANICAL WOOD PULP

The invention relates to apparatus for producing mechanical wood pulp of the type having a grinding stone with at least one wood supply chute in which the wood which is to be ground is pressed onto the grinding stone, a trough or a collecting channel underneath the grinding stone, and water supplying devices for moistening the grinding stone and the grinding zone.

Due to the physical conditions which prevail during the grinding of wood fibre to produce paper pulp, very varied temperatures arise in the grinding zone. This, for example, at the start of the grinding zone a mix temperature of less than 100° C. prevails, produced by the entrained water carried up out of the trough, the moisture in the wood and the wood itself. With the grinding of the wood, the temperature then rises correspondingly in the supply chute, and vaporisation and local over-heating may occur. This affects the fibre quality detrimentally. Over the length of the grinding zone very different fibre lengths and shapes are produced.

It is now already known that the lignin which binds the wood fibres is softened in the presence of water and a temperature of more than 80° C., and particularly more than 100° C., so that wood fibres which have been little shortened by the granules on the grinding stone can be released. This means that, with a simultaneously higher content of long fibres a paper pulp with greater strength is produced.

For this reason, it has already been proposed that wood should be ground in the presence of an over-pressure (e.g. from German Laid-Open Patent Specification No. 28 12 299). In this case, by means of sluices and an appropriate supply of expressed air in the wood supply chute it is ensured that an over-pressure prevails in the grinding zone.

However, one disadvantage of this is that such apparatus is relatively expensive.

The present invention is therefore based on the problem of providing apparatus for producing mechanical wood pulp in which an adequate supply of liquid into the grinding zone is ensured in a simple way, while at the same time grinding can be carried out, if required, at water temperatures higher than 100° C.

According to the invention, apparatus of the kind referred to above is characterized in that at least one closed water tank is set up on the grinding stone in front of the supply chute, viewed in the direction of rotation of the grinding stone, said water tank being sealed at least on the side furthest away from said supply chute, having a supply line for pressurised water, and having outlet holes directed towards the surface of the stone.

By providing a water tank in accordance with the invention, it is possible to supply pressurised water. This measure makes it possible for the water to penetrate deep into the pores in the grinding stone, counter to the centrifugal force.

This pressurised water can then emerge out of the grinding stone again in the grinding zone, under pressure (due to the centrifugal effect). As a relatively tight seal is produced due to the wood being pressed on, a corresponding over-pressure occurs in this region, so that water temperatures of more than 100° C. can be achieved.

If the water tank is not sealed off in the direction of the supply chute, but if, on the contrary, there is a small gap, then in addition to the entrained water carried along from the trough, pressurised water can be introduced into the grinding zone over the surface of the stone.

If the gap is made wedge-shaped, tapering down in the direction of the supply chute, the pressure effect of the water is further increased.

Provision is made in a development according to the invention for the water tank to be made re-adjustable. This measure enables the wear on the stone to be accommodated accordingly.

The same also applies to the seal on the side furthest away from the supply chute, which also has a re-adjustable sealing plug.

It is advantageous if the water tank is made and/or set on the grinding stone in such a way that between the water tank and the surface of the grinding stone a wedge-shaped gap is formed, being sealed at least on the side furthest away from the supply chute.

This measure produces a further increase in pressure, similarly to when there is a wedge-shaped gap between the water tank and the supply chute.

Another development according to the invention consists in having the water tank extend approximately over the width of the grinding stone and providing it laterally with labyrinth seals.

It is advantageous in this case if deflection plates are arranged projecting laterally beyond the grinding stone in the vicinity of the water tank and the wood supply chute. These deflection plates hold back any grinding water which might possible emerge between the end faces of the stone and the deflection plates.

It is advantageous if a cleaning device is arranged in the water tank in front of the outlet holes.

Generally, filtered or also fibre-containing recycled water is used for the pressurised water. This cleaning device prevents the outlet holes, which may optionally be constructed in the form of nozzles, from becoming blocked.

One embodiment of the cleaning device according to the invention consists in it having a rotating brush.

Provision may be made in this case for the brush to have a rotating shaft on which bristles are distributed evenly over its circumference.

A further possibility for introducing more grinding water into the grinding zone consists in providing recesses in the grinding stone surface.

The basic principles of one embodiment example of the invention will now be described in the following, with reference to the accompanying Drawing, in which.

Figure 2:
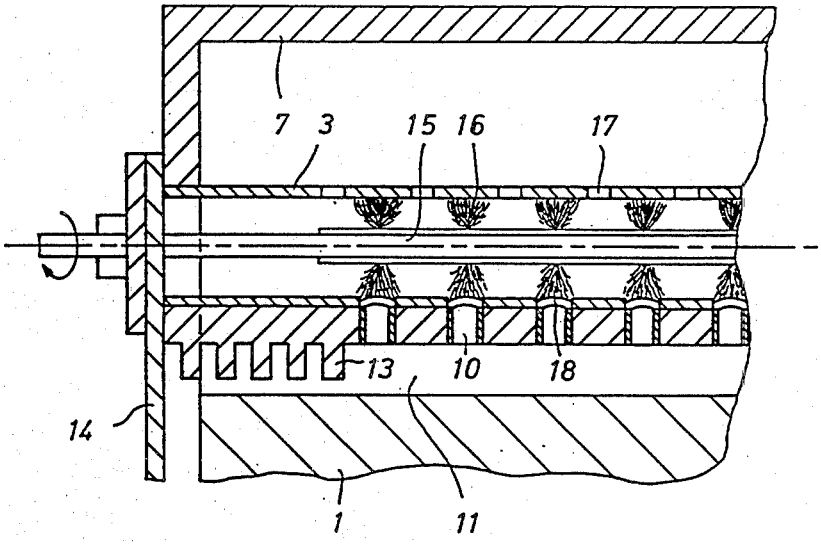
FIG. 2 is a detail from the plan view of the water tank.

As usual, the apparatus for producing mechanical wood pulp has a rotatable grinding stone 1, which is associated with a wood supply chute 2. In the wood supply chute 2 the wood is pressed against the grinding stone by a pressing device (not shown). Only one wood supply chute is shown in the Drawing. Within the scope of the invention, however, both a so-called two-press grinder with two wood supply chutes or a constant grinder with a continuous supply of wood may be used. Again, a chain conveyor, a toothed wheel conveyor of some other kind of wood conveyor may be provided in the supply chute 2 instead of a pressing ram. Underneath the grinding stone 1 there is a trough 4 which is used to hold the wood pulp. The level of the stock suspension in the trough 4 can be set appropriately by means of an overflow weir 5. A liquid supply line 6 is used for diluting purposes.

In front of the wood supply chute 2 there is a water tank 7, which is set up on the grinding stone 1. On the side furthest from the supply chute 2 the water tank 7 is sealed off by a sealing plug 8. The sealing plug 8 may consist, for example, of hardwood, which can be re-adjusted accordingly when worn. The water tank is equipped with a supply line 9 via which the water under pressure is introduced into the interior of the water tank 7. Via a plurality of bores 17 and outlet holes 10 distributed across the width of the grinding stone 1 water under pressure passes into a wedge-shaped gap 11 between the water tank 7 and the surface of the grinding stone 1. To improve the transportation of water into the grinding zone there are recesses 12 in the surface of the grinding stone 1. Additional uniformity in the quality of the pulp is achieved if the fibrous stock suspension brought with the entrained water from the pulp trough 4 into the grinding zone has a constant structure. This is achieved if mixed pulp from the whole grinding station is conducted continuously through the pulp trough via the liquid line 6. Labyrinth seals 13 are provided to seal the water tank 7 at the sides. Grinding water which has emerged is held back at the end faces of the stone by means of deflection plates 14.

In front of the outlet holes 10 in the water tank 7 there is a cleaning device which consists of a rotating shaft 15 on which bristles 16 are fixed, distributed evenly over the circumference. By means of these rotating bristles 16 the outlet holes 10 are kept clear of impurities. A stationary pipe 3 which is equipped with bores 17 to admit pressurised water is used to guide the rotating bristles 16. The outlet holes 10 can be formed by slit nozzles inserted in bores in the water tank 7, as shown in FIG. 2.

Figure 1:
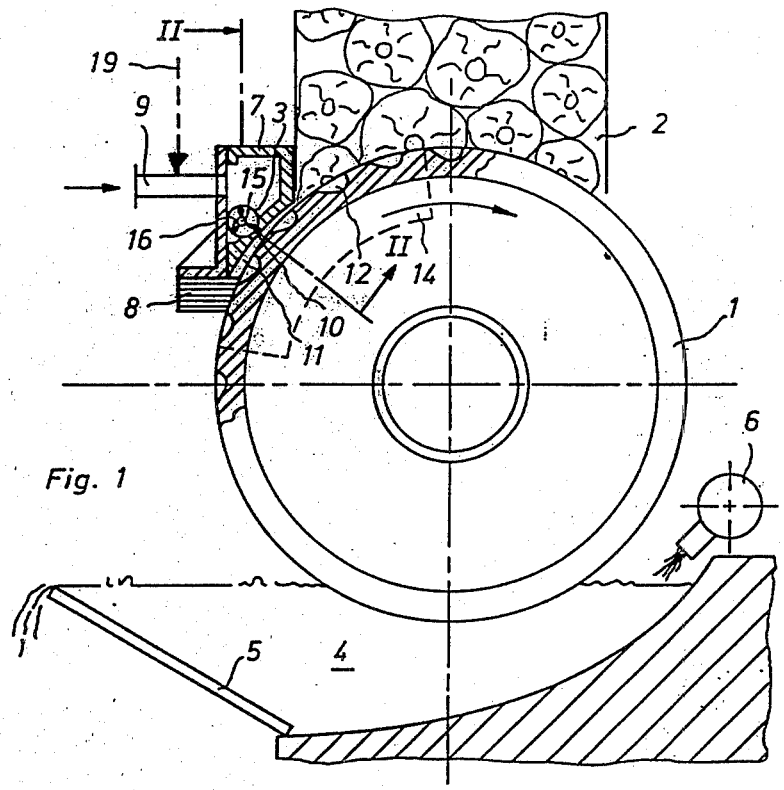
FIG. 1 is a side view of the grinding device.

As shown by the dashed line in FIG. 1, the supply line 9 can be connected to a recycled water line or a fibrous stock line 19 through which all or some of the recycled water or fibrous stock is introduced into the interior of the water tank 7.

We claim:

1. Apparatus for producing mechanical wood pulp, comprising:

a rotatable, roller-type wood grinding stone having a grinding surface; a wood supply chute for supplying wood to the grinding surface of the grinding stone as the grinding stone rotates past the chute;

a water supply device for supplying water to the grinding surface of the grinding stone in the vicinity where the grinding chute supplies wood to the grinding surface; the water supply device comprising:

a closed water supply means for supplying water at a temperature ranging above 100° C. under pressure to maintain said temperature, the closed water supply means comprising a housing extending circumferentially of the grinding stone for a limited arcuate extent and extending axially of the grinding stone for substantially the full width thereof; said housing being closed to maintain pressure on the water therein and being open on a first side adjacent the grinding stone; the housing including second sides meeting the first side and closing off the housing and the second sides of the housing closely abutting the grinding stone to form, together with the surface of the grinding stone, a pressurized water retaining chamber; the first side of the housing including water transmitting means for transmitting water to the grinding surface of the grinding stone while substantially maintaining the temperature and pressure of the water; the water transmitting means being located at the grinding surface in front of the supply chute as viewed in the direction of the rotation of the grinding stone.

2. Apparatus according to claim 1, further comprising a trough underneath the grinding stone for collecting ground wood pulp.

3. Apparatus according to claim 1, wherein the water supply means second sides contact the grinding surface, whereby the water supply means may be worn, the water supply means is adjustable in position to accommodate wear of the water supply means from the grinding stone for maintaining the water supply means for delivering water under pressure to the grinding surface.

4. Apparatus according to claim 1, wherein there is a re-adjustable sealing plug on the side of the water supply means furthest upstream with respect to the direction of rotation of the grinding stone, and the plug contacts the grinding surface and is worn thereby, the plug being re-adjustable for maintaining the water supply means for delivering water under pressure to the grinding surface.

5. Apparatus according to claims 3, or 4, wherein the water transmitting means comprises a closed up wedge-shaped gap defined in the water supply means above the grinding surface, the gap being sealed off at least on the side thereof furthest upstream with respect to the direction of rotation of the grinding stone, and the gap tapers downstream with respect to that direction of rotation.

6. Apparatus according to claim 5, wherein the water transmitting means includes outlet holes from the water supply means for directing water toward the grinding surface, and the outlet holes open into the wedge-shaped gap.

7. Apparatus according to claim 6, further comprising a cleaning device arranged in front of the outlet holes for cleaning material from the entrance to the outlet holes.

8. A water tank according to claim 7, further comprising deflection plates, which project laterally beyond the lateral sides of the grinding stone, and arranged in the vicinity of the water supply means and the wood supply chute.

9. Apparatus according to claim 5, further comprising a supply line to the tank for pressurised water, and the supply line being connected to a fibrous stock line.

10. Apparatus according to claim 9, wherein the water transmitting means includes outlet holes from the tank for directing water toward the grinding surface and the outlet holes are formed by slit nozzles defined in the water tank.

11. Apparatus according to claim 5, further comprising seals at the lateral edges of the wedge-shaped gap, and along the lateral sides of the grinding stone.

12. Apparatus according to claim 11, further comprising deflection plates, which project laterally beyond the lateral sides of the grinding stone, and arranged in the vicinity of the water supply means and the wood supply chute.

13. Apparatus according to claim 5, wherein the grinding stone has water receiving recesses defined on its surface.

14. Apparatus according to claim 1, wherein the grinding stone has water receiving recesses defined on its surface.

15. Apparatus according to claim 1, wherein the water supply means in sealed at least at the side thereof that is furthest upstream with respect to the direction of rotation of the grinding stone.

16. Apparatus according to either of claims 1 or 15, wherein the water transmitting means includes outlet holes from the water supply means for directing water toward the grinding surface.

17. A grinding stone according to claim 16, further comprising a cleaning device arranged in front of the outlet holes for cleaning material from the entrance to the outlet holes.

18. Apparatus according to claim 17, wherein the cleaning device comprises a rotatable brush that is rotatable past the outlet holes.

19. Apparatus according to claim 18, wherein the brush comprises a rotatable shaft on which bristles are fixed and the bristles are distributed evenly over the circumference of the shaft.

20. Apparatus according to claim 16, wherein the grinding stone has water receiving recesses defined on its surface.

21. Apparatus according to 15, further comprising seals at the sides of the transmitting means along the lateral sides of the grinding stone.

22. Apparatus according to claim 21, further comprising a supply line to the tank for pressurised water, and the supply line being connected to a line for cleaned recycled water.

23. Apparatus according to claim 1, wherein the grinding stone has water receiving recesses defined on its surface.

* * * * *